US010772184B2

(12) United States Patent
Tanaka et al.

(10) Patent No.: US 10,772,184 B2
(45) Date of Patent: Sep. 8, 2020

(54) IGNITION DEVICE

(71) Applicants: DENSO CORPORATION, Kariya, Aichi-pref. (JP); PLASMA APPLICATIONS CO., LTD., Hamamatsu-shi, Shizuoka (JP); TOKYO KEIKI INC., Tokyo (JP)

(72) Inventors: Daisuke Tanaka, Nisshin (JP); Fumiaki Aoki, Nisshin (JP); Akimitsu Sugiura, Kariya (JP); Masashi Kando, Hamamatsu (JP); Jan Husarik, Hamamatsu (JP); Hiroshi Okajima, Tokyo (JP)

(73) Assignees: DENSO CORPORATION, Kariya (JP); PLASMA APPLICATIONS CO., LTD., Hamamatsu-shi (JP); TOKYO KEIKI INC., Tokyo (JP)

( * ) Notice: Subject to any disclaimer, the term of this patent is extended or adjusted under 35 U.S.C. 154(b) by 0 days.

(21) Appl. No.: 16/565,910

(22) Filed: Sep. 10, 2019

(65) Prior Publication Data

US 2020/0084872 A1 Mar. 12, 2020

(30) Foreign Application Priority Data

Sep. 12, 2018 (JP) ..... 2018-170851

(51) Int. Cl.
*H05H 1/52* (2006.01)
*H01T 13/32* (2006.01)
(Continued)

(52) U.S. Cl.
CPC ..... *H05H 1/52* (2013.01); *F02M 57/06* (2013.01); *F02P 13/00* (2013.01); *H01T 13/32* (2013.01)

(58) Field of Classification Search
CPC ..... H01T 15/00; F02N 57/06; F02P 13/00
See application file for complete search history.

(56) References Cited

U.S. PATENT DOCUMENTS 5,131,376 A * 7/1992 Ward ..... F02P 3/0838 123/597
8,887,683 B2 * 11/2014 Smith ..... F02P 9/007 123/143 B (Continued)

FOREIGN PATENT DOCUMENTS

JP 2010-101207 5/2010
WO WO-2013080873 A1 * 6/2013 ..... F02P 23/045
WO WO-2017050752 A1 * 3/2017 ..... F01K 21/045

*Primary Examiner* — Amy Cohen Johnson
*Assistant Examiner* — Srinivas Sathiraju
(74) *Attorney, Agent, or Firm* — Nixon & Vanderhye PC

(57) ABSTRACT

An ignition device ignites a mixture of air and fuel gas by plasma to generate an initial flame. The ignition device includes a spark plug having an inner conductor, a cylindrical outer conductor that holds the inner conductor inside, and a dielectric provided between the inner conductor and the outer conductor, and the spark plug configured to emit an electromagnetic wave to a plasma formation space between the inner conductor and the outer conductor to generate a plasma. The ignition device includes an electromagnetic wave power supply that generates the electromagnetic wave by inputting the electromagnetic wave power Ps to the spark plug and a power supply control unit that controls the electromagnetic wave power supply. The electromagnetic wave power supply is configured to generate high frequency power at a number of different frequencies. The power supply control unit outputs at least one of the plurality of high frequency powers generated by the electromagnetic wave power supply as the electromagnetic wave power.

10 Claims, 9 Drawing Sheets

(51) Int. Cl.
*F02P 13/00* (2006.01)
*F02M 57/06* (2006.01)

(56) References Cited

U.S. PATENT DOCUMENTS

| | | | | |
|---|---|---|---|---|
| 9,228,559 | B2 * | 1/2016 | Ikeda | F02M 27/042 |
| 9,624,898 | B2 * | 4/2017 | Smith | F02P 9/007 |
| 9,638,157 | B2 * | 5/2017 | Smith | F02P 9/007 |
| 9,863,800 | B2 * | 1/2018 | Ito | H01Q 1/225 |
| 10,122,066 | B2 * | 11/2018 | Ito | G01S 7/03 |
| 10,132,286 | B2 * | 11/2018 | Ikeda | F02P 3/01 |
| 2014/0041611 | A1 | 2/2014 | Ikeda et al. | |
| 2014/0327357 | A1 * | 11/2014 | Smith | F02P 9/007 315/39 |
| 2016/0281670 | A1 * | 9/2016 | Ikeda | F02P 3/01 |
| 2017/0082083 | A1 * | 3/2017 | Lowery | H01P 7/06 |
| 2017/0276110 | A1 * | 9/2017 | Ikeda | F02M 57/06 |
| 2018/0279460 | A1 * | 9/2018 | Kinoshita | F02P 23/045 |
| 2018/0363618 | A1 * | 12/2018 | Kinoshita | F02P 3/01 |
| 2019/0057808 | A1 * | 2/2019 | Kinoshita | H01F 3/14 |
| 2019/0103731 | A1 * | 4/2019 | Tanaka | H01T 13/04 |
| 2020/0006925 | A1 * | 1/2020 | Shigenaga | H01T 13/34 |
| 2020/0049122 | A1 * | 2/2020 | Lowery | F02P 23/045 |

* cited by examiner

IGNITION DEVICE

CROSS REFERENCE TO RELATED APPLICATION

The present application is based on Japanese Patent Application No. 2018-170851 filed on Sep. 12, 2018, disclosure of which are incorporated herein by reference.

TECHNICAL FIELD

The present invention relates to an ignition device.

BACKGROUND

An ignition device for an internal combustion engine or the like generates high frequency plasma and ignites a mixture of air and fuel. Such an ignition device has a power supply for inputting high frequency electromagnetic wave power to a spark plug. The electromagnetic wave provided from power supply is emitted into plasma formation space and generates plasma. Here, the impedance of a transmission line of the electromagnetic wave power, including the plasma formation, space varies depending on the state of the plasma formation space. If the impedance of the power supply and that of the transmission line (i.e., the load) are not matched, part of electromagnetic wave power will be reflected toward power supply and thus decrease the portion of power transferred to the load.

Therefore, Patent Document 1 discloses an impedance matching device that adjusts the impedance of a transmission line by using a stub. This impedance matching device adjusts the impedance of the transmission line by adjusting the short circuit position in the stub by switching multiple switches.

PATENT DOCUMENT

Patent Document 1: WO 2012/105570

SUMMARY

However, when impedance matching is performed by using the stub, multiple switches is used. Then, power loss occurs when switching between the multiple switches. In addition, it may be difficult to switch the switch in a short time. In that case, there is a possibility that it may be difficult to appropriately perform impedance matching in accordance with the time variation of the state of the plasma formation space. That is, in the plasma formation space, the impedance varies before and after plasma generation and before and after flame generation. Accordingly, impedance matching may be difficult to achieve by means of switching of multiple switches. As a result, it may be difficult to efficiently utilize energy of electromagnetic wave for ignition.

The present disclosure has been made in view of such problems, and the present disclosure provides the ignition device capable of efficiently utilizing energy of electromagnetic wave.

One embodiment of the present disclosure is an ignition device that ignites a mixture of air and fuel gas by plasma to generate an initial flame.

The ignition device includes a spark plug having an inner conductor, a cylindrical outer conductor that holds the inner conductor inside, and a dielectric provided between the inner conductor and the outer conductor, and the spark plug configured to emit an electromagnetic wave to a plasma formation space between the inner conductor and the outer conductor to generate a plasma, an electromagnetic wave power supply that generates the electromagnetic wave and delivers an electromagnetic wave power to the spark plug, and a power supply control unit that controls the electromagnetic wave power supply.

The electromagnetic wave power supply is capable to generate high frequency power at a number of different frequencies.

The electromagnetic wave power supply is configured by power supply control unit to output electromagnetic wave power at least one of the number of frequencies.

In the ignition device, the electromagnetic wave power supply is configured to generate high frequency powers of different frequencies. The electromagnetic wave power supply is configured by control unit to output electromagnetic wave power at least one of the number of frequencies. By varying electromagnetic wave frequency corresponding to the impedance state of plasma formation space, impedance matching can be properly performed. As a result, energy of electromagnetic wave can be efficiently used as ignition energy.

As described above, according to the above embodiment, it is possible to provide an ignition device capable of efficiently utilizing energy of electromagnetic wave.

DETAILED DESCRIPTION

First Embodiment

One Embodiment of the ignition device will be described with reference to FIGS. 1 to 5.

The ignition device 1 of the present embodiment ignites a mixture of air and fuel gas using plasma to generate an initial flame.

Figure 1:
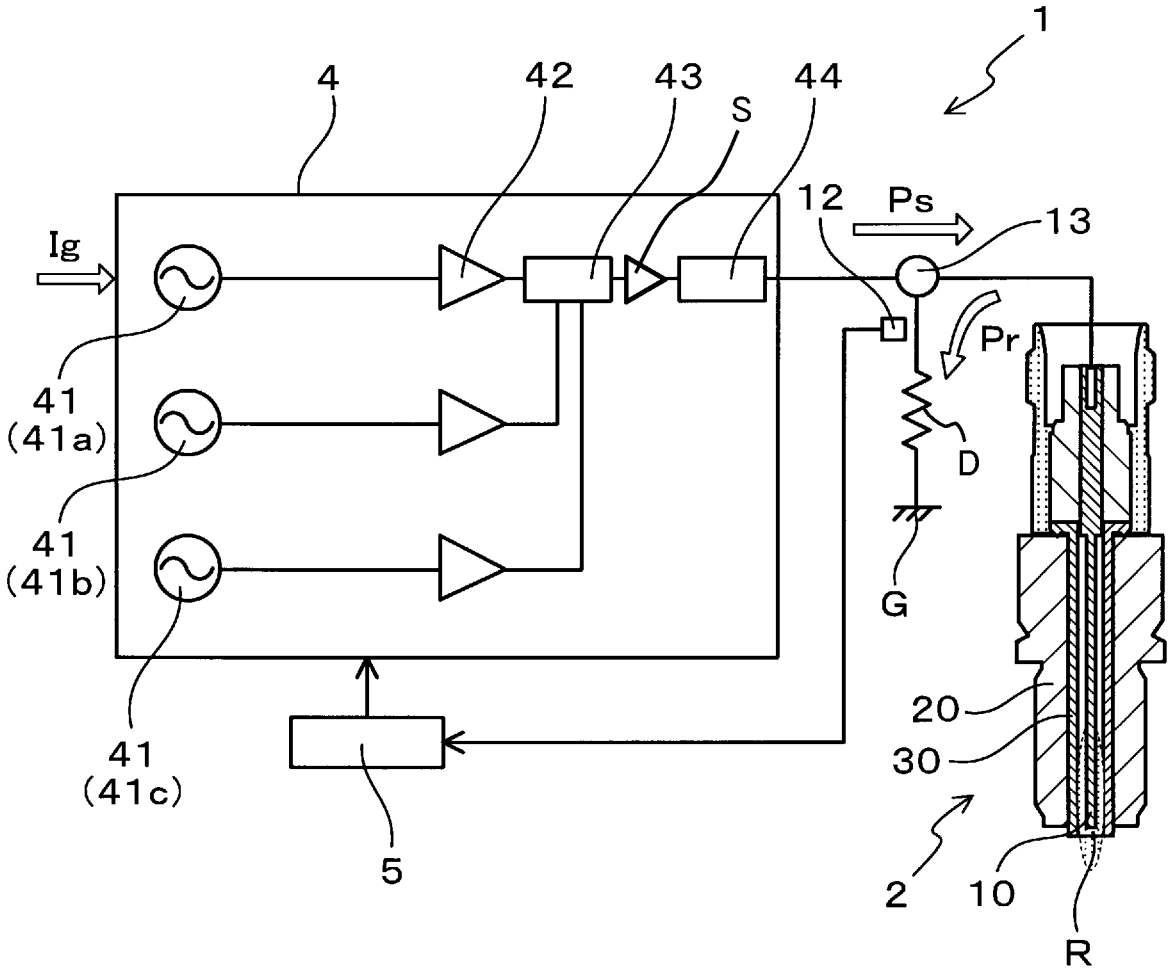
FIG. 1 is a schematic view of an ignition device according to a first embodiment.

Then, as shown in FIG. 1, the ignition device 1 includes a spark plug 2, an electromagnetic wave power supply 4, and a power supply control unit 5.

Figure 2:
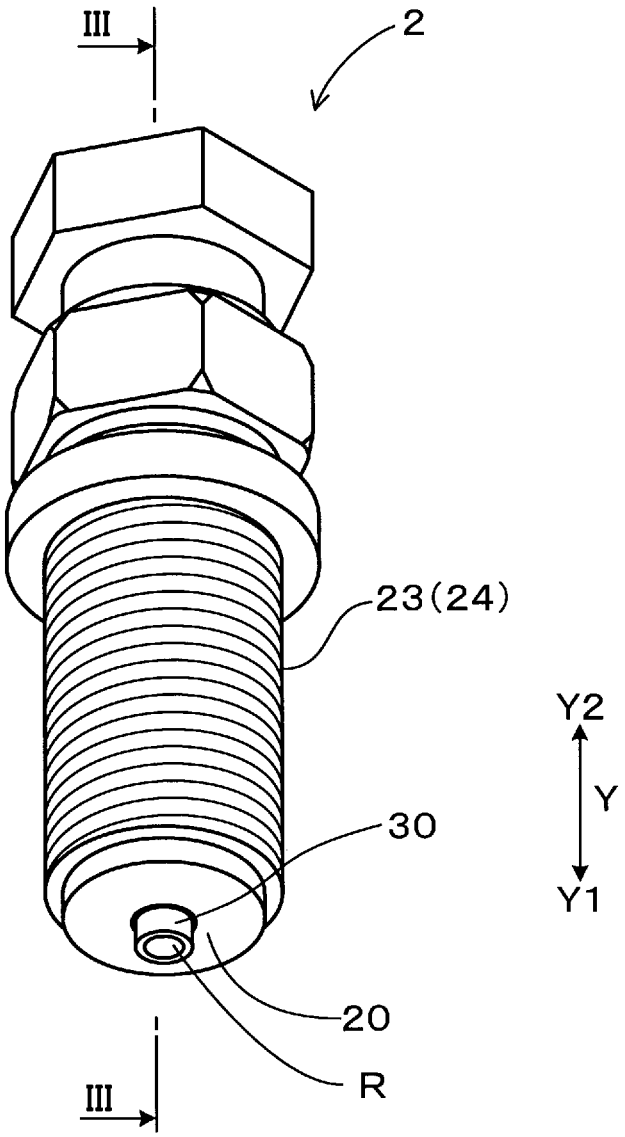
FIG. 2 is a perspective view of the spark plug according to the first embodiment.
Figure 3:
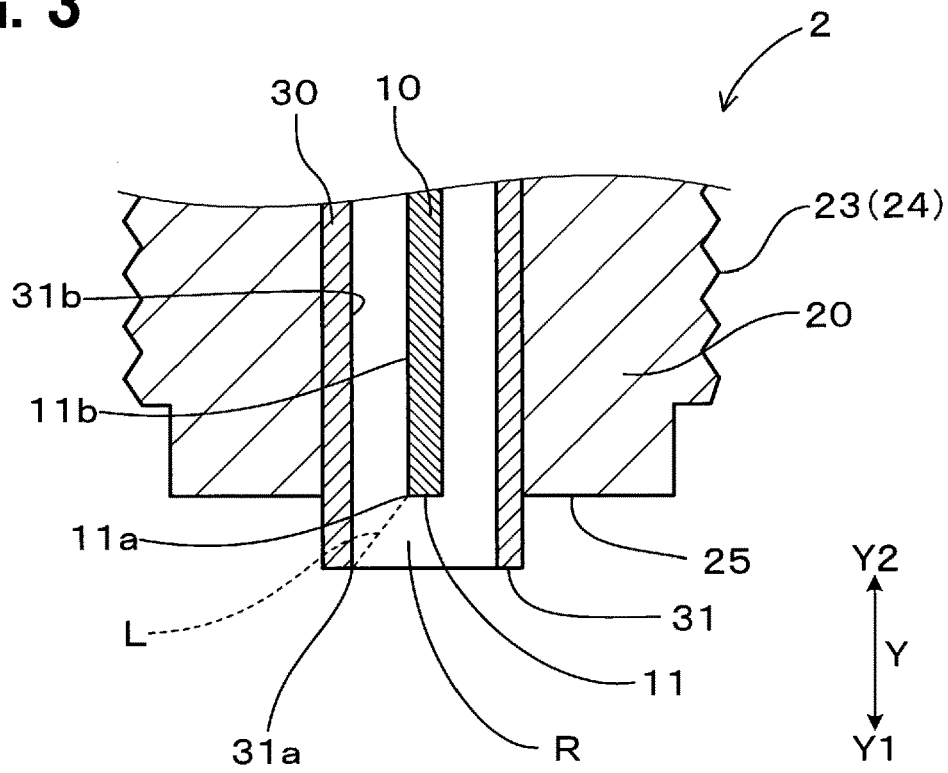
FIG. 3 is a partially enlarged view of a cross section taken along line III-III in FIG. 2.

As shown in FIGS. 2 and 3, the spark plug 2 includes an inner conductor 10, a cylindrical outer conductor 20 for holding the inner conductor 10 inside, and a dielectric 30 provided between the inner conductor 10 and the outer conductor 20. The spark plug 2 is configured to emit an electromagnetic wave to a plasma formation space R between the inner conductor 10 and the outer conductor 20 to generate plasma.

Electromagnetic power Ps is generated in electromagnetic wave power supply 4 and is delivered into spark plug 2. The power supply control unit 5 controls the electromagnetic wave power supply 4. The electromagnetic wave power supply 4 is configured by power supply control unit 5 to output electromagnetic wave power Ps at least one of the number of frequencies generated in the electromagnetic wave power supply 4.

In the present embodiment, the electromagnetic wave power supply 4 has multiple oscillators 41. Each of the multiple oscillators 41 generates high frequency power of mutually different frequencies.

The electromagnetic wave power supply 4 is configured by power supply control unit 5 to output electromagnetic wave power Ps at least one of the number of frequencies generated in the oscillators 41.

As shown in FIG. 1, the electromagnetic wave power supply 4 has a combiner 43 that combines a number of high frequency powers generated by the multiple oscillators 41. Then, the electromagnetic wave power supply 4 combines the number of high frequency powers in the combiner 43, and inputs it as the electromagnetic wave power Ps to the spark plug 2. Optionally, next amplifier stage S can be equipped after the combiner 43.

As shown in FIG. 3, the outer conductor 20 of the spark plug 2 also serves as a housing 23 of the spark plug 2. On an outer peripheral surface of the housing 23, a mounting threaded portion 24 for screwing to the internal combustion engine is formed.

As shown in FIG. 2, the dielectric 30 has a tubular shape, and is located inside the outer conductor 20 so as to share the central axis with the outer conductor 20. As shown in FIG. 3, the dielectric tip 31 which is a tip on the tip side Y1 of the dielectric 30 is located on the tip side Y1 with respect to an outer conductor tip 25 which is the end on the tip side Y1 of the outer conductor 20. That is, the dielectric tip 31 projects to the tip side Y1. It is preferable to use a material that increases the electric field strength in the vicinity of the inner conductor tip 11 as the material of the dielectric 30. By increasing the electric field strength in the vicinity of the inner conductor tip 11 which is the end on the tip side Y1 of the inner conductor 10, a partial discharge is easily formed between the inner conductor tip 11 and the dielectric tip 31. A material (for example, alumina) having a high dielectric constant can be used as a material of the dielectric 30 for increasing the electric field strength in the vicinity of the inner conductor tip 11.

The inner conductor 10 has a cylindrical shape, and is located inside the dielectric 30 so as to share the central axis with the dielectric 30. An outer diameter of the inner conductor 10 is smaller than an inner diameter of the dielectric 30, and the outer peripheral surface 11*b* of the inner conductor 10 and the inner peripheral surface 31*b* of the dielectric 30 are separated by air gap. The inner conductor tip 11 is located on a proximal end side Y2 with respect to the dielectric tip 31. The position of the inner conductor tip in the plug axial direction Y is the same as the position of the outer conductor tip 25 of the outer conductor 20.

Moreover, as a material of the inner conductor 10, it is possible to use a material that easily absorbs high frequency energy or a material that partially contains the above material in order to make it easy to heat the inner conductor tip 11 of the inner conductor 10. Alternatively, the inner conductor tip 11 of the inner conductor 10 may be easily heated by coating the outer peripheral surface 11*b* of the inner conductor 10 or the inner peripheral surface 31*b* of the dielectric 30 with a material that easily absorbs high frequency energy. For example, carbon can be used as a material that easily absorbs high frequency energy. For example, stainless steel (SUS) can be used as a material partially including a material that easily absorbs high frequency energy.

As shown in FIG. 3, the plasma formation space R is formed as a space surrounded by the inner peripheral surface 31*b* of the dielectric 30, the inner conductor tip 11 of the inner conductor 10, and the outer peripheral surface 11*b* of the inner conductor 10. The plasma formation space R is a space including a virtual line segment L connecting the outer edge 11*a* of the inner conductor tip 11 and the inner edge 31*a* of the dielectric tip 31. That is, the inner conductor tip 11 and the dielectric tip 31 are separated from each other by the plasma formation space R. The length in the plug axial direction Y of the coaxial pipe consisting of the inner conductor 10, the outer conductor 20 and the dielectric 30 can be made such that the electric field strength of the inner conductor tip 11 becomes maximum, for example, a quarter of the wavelength of the high frequency to be input.

As shown in FIG. 1, the electromagnetic wave power supply 4 is connected to the spark plug 2. The electromagnetic wave power supply 4 includes multiple oscillators 41 and multiple amplifiers 42. The electromagnetic wave power supply 4 outputs the electromagnetic wave power Ps in response to the input of the ignition signal Ig. That is, when the ignition signal Ig is input to the electromagnetic wave power supply 4, high frequency power of a predetermined frequency is generated from each of multiple oscillators 41 in the electromagnetic wave power supply 4. Each high frequency power is amplified by the amplifier 42 and combined by the combiner 43. The electromagnetic wave power combined from powers at multiple frequencies is input to the spark plug 2 as the electromagnetic wave power Ps via an impedance transformation unit 44 and the circulator 13.

In the present embodiment, the impedance transformation unit 44 is provided on the output side of the combiner 43 in the electromagnetic wave power supply 4. The impedance transformation unit 44 can match the electromagnetic wave power supply (source) impedance to the (load) impedance of the plasma formation space R. The impedance transformation unit 44 can be configured to change at least one of an inductance and a capacitance of the transmission line of the electromagnetic wave power Ps, and can be achieved by, for example, a matching device such as a double slug tuner. The impedance transformation unit 44 can be used, for example, when adjusting the impedance of the transmission line to some extent before shipment of the ignition device 1.

The frequency of the high frequency power generated by each oscillator 41 is not particularly limited, but can be different from each other between 2.40 and 2.50 GHz. When there is an impedance discontinuity in the transmission line, the reflected power Pr is generated, and the incident power to the spark plug 2 is reduced.

In the present embodiment, the electromagnetic wave power supply 4 has three oscillators 41. In addition, three amplifiers 42 for amplifying high frequency power generated from each of the oscillators 41 are provided.

The high frequency power generated from the three oscillators 41 (41*a*, 41*b*, 41*c*) have mutually different frequencies fa, fb, fc. For example, the frequency fa of the high frequency power generated from the oscillator 41*a* can be 2.43 GHz, the frequency fb of the high frequency power generated from the oscillator 41*b* can be 2.45 GHz, and the frequency fc of the high frequency power generated from the oscillator 41*c* can be 2.47 GHz. Then, the number of generated high frequency powers are amplified and then combined in the combiner 43 and output as electromagnetic wave power Ps including the multiple high frequencies.

A circulator 13 directs the reflected power Pr from the spark plug 2 to the dummy load D on the ground G side. In the present embodiment, the reflected power Pr is detected by a reflected power detector 12. The detected value by the reflected power detector 12 is transmitted to the power supply control unit 5.

That is, the ignition device 1 further includes the reflected power detector 12 that detects the reflected power Pr from the spark plug 2. The power supply control unit 5 adjusts the configuration of the high frequency power included in the electromagnetic wave power Ps in accordance with the detected value by the reflected power detector 12.

When impedance matching is not achieved, the reflected power becomes large. Therefore, impedance matching needs to be adjusted so the reflected power is reduced. However, the impedance of the transmission line changes according to the change of the state of plasma formation space R. Specifically, the impedance of the transmission line differs between the following states of plasma formation space: first state St1, second state St2, and third state St3. The first state St1 is a state in which plasma is not formed in the plasma formation space R. The second state St2 is a state in which plasma is formed in the plasma formation space R. The third state St3 is a state in which an initial flame is formed in the plasma formation space R by plasma. The first state St1, the second state St2, and the third state St3 sequentially change over a short time during each discharge cycle (that is, one discharge duration).

In the present embodiment, as described above, high frequency powers of three different frequencies are included in the electromagnetic wave power Ps. Then, these three high frequency power frequencies fa, fb and fc have the frequency fb that matches the impedance in the first state St1, the frequency fa that matches the impedance in the second state St2, and the frequency fc that matches in the third state St3.

For example, the frequency fb of the high frequency power generated from the oscillator 41*b* is set so as to be matched to the impedance in the first state St1, the frequency fa of the high frequency power generated from the oscillator 41*a* is set so as to be matched to the impedance in the second state St2, and the frequency fc of the high frequency power generated from the oscillator 41*c* is set so as to be matched to the impedance in the third state St3. These frequencies fa, fb and fc can be set in advance as predetermined values, for example, between 2.40 and 2.50 GHz as described above.

The power supply control unit 5 adjusts ratio of high frequency powers in time series during each discharge cycle, and inputs it to the spark plug 2 as the electromagnetic wave power Ps. That is, the combined ratio of the three high frequency powers is modified between the first state St1, the second state St2, and the third state St3. Here, the combined ratio of high frequency powers is defined as the ratio of the magnitudes of the high frequency powers.

Figure 4:
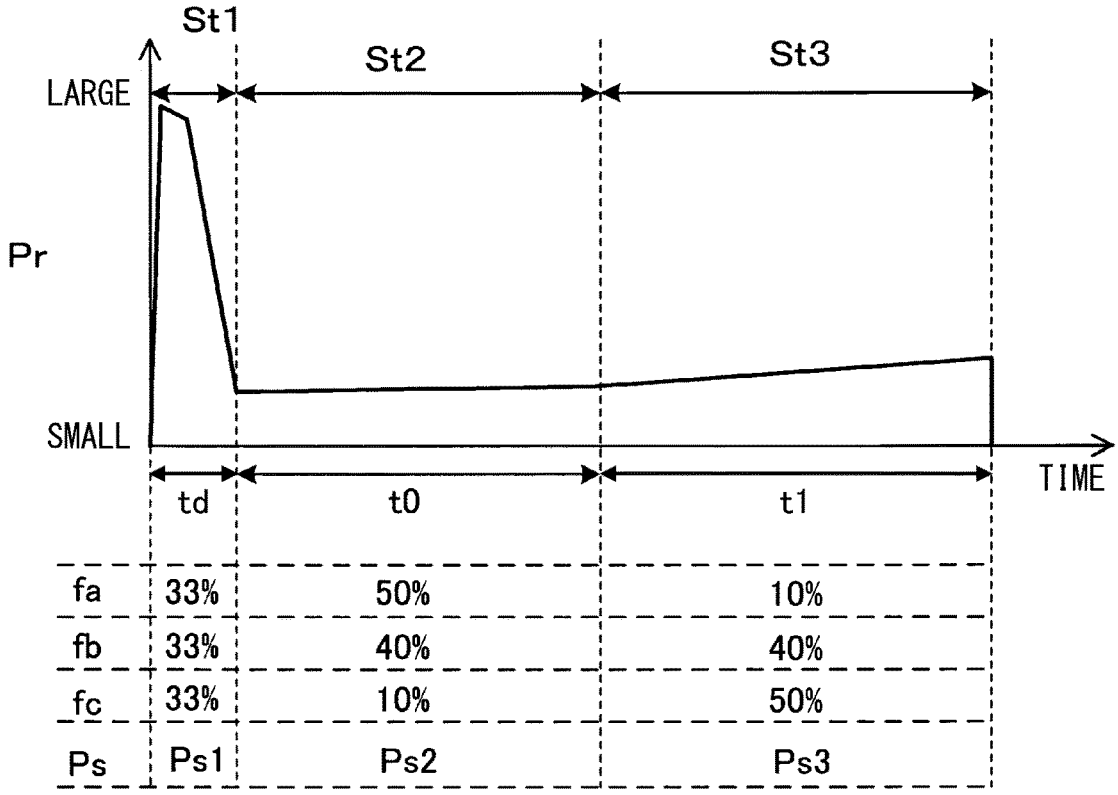
FIG. 4 is a conceptual diagram showing an example of the relationship between a change in reflected power during one cycle, a state of a plasma formation space, and a combined ratio of electromagnetic wave power in the first embodiment.

For example, as shown in FIG. 4, in the first state St1, three high frequency powers (frequency fa, fb, fc) are combined equally i.e. electromagnetic wave power delivered at frequency fa is equal to power delivered at frequency fb and this is equal to power delivered at frequency fc. The electromagnetic wave power Ps delivered during the first state St1 is referred to as a first electromagnetic wave power Ps1. Further, in the second state St2, the high frequency power (frequency fa) generated from the first oscillator 41*a* is combined so that the largest portion is of electromagnetic wave power provided at frequency fa. The electromagnetic wave power Ps during second state St2 is referred to as a second electromagnetic wave power Ps2. Also, in the third state St3, the high frequency power (frequency fc) generated from the third oscillator 41*c* is combined so that the largest portion is of electromagnetic wave power provided at frequency fc. The electromagnetic wave power Ps during third state St3 is referred to as a third electromagnetic wave power Ps3.

Although the graph in the upper part of FIG. 4 schematically shows the time variation of the reflected power Pr, this is only illustrative graph for explaining the variation of the combined ratio of the high frequency powers in the electromagnetic wave power Ps shown in the lower part of the same figure, and serves only as a rough reference. The same applies to FIGS. 6 and 7 described later.

The first state St1, the second state St2, and the third state St3 can be determined from measurement of the reflected power Pr detected by the reflected power detector 12. That is, the power supply control unit 5 determines the state of the plasma formation space R based on the detected value measured by the reflected power detector 12. Alternatively, the switching from the second state St2 to the third state St3 can also be estimated by an elapsed time from the start time of the second state St2 (time t0 in FIG. 4). Then, when change of the state is determined, the combined ratio of the high frequency powers is adjusted.

Figure 5:
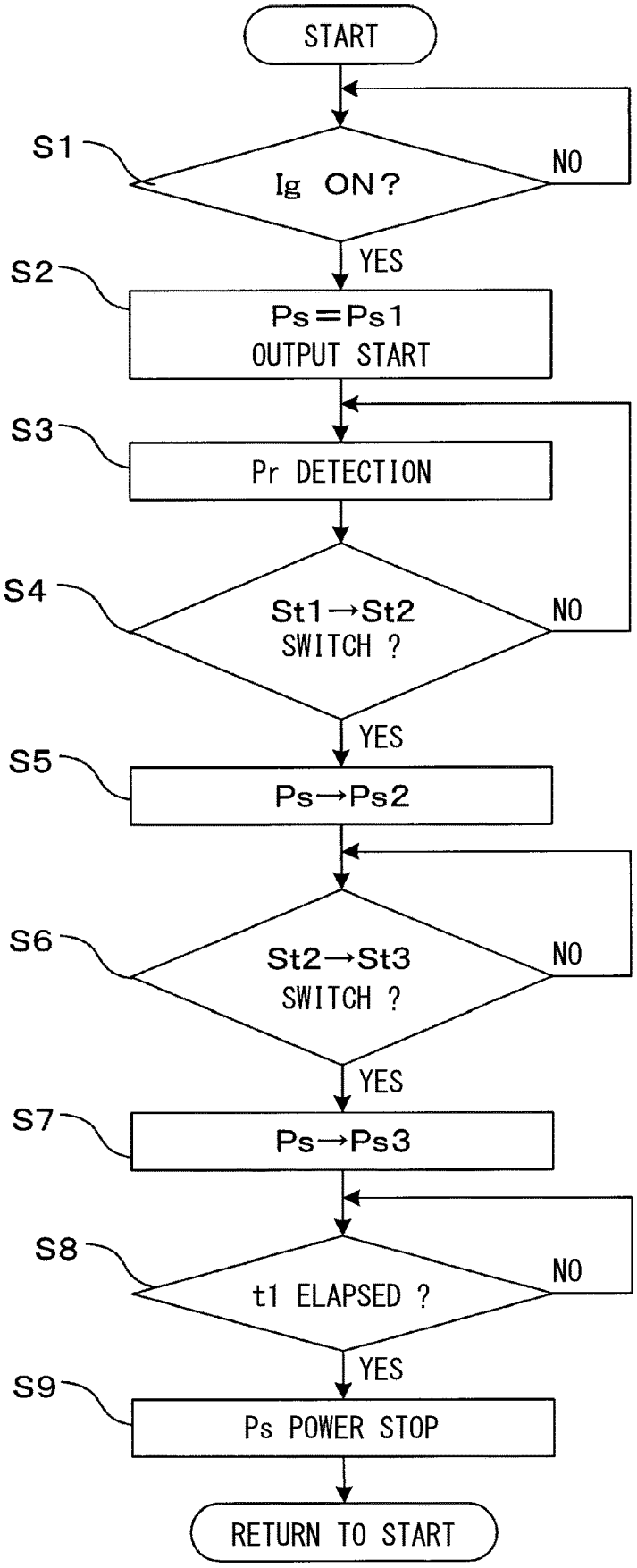
FIG. 5 is a flow chart of an operation of the ignition device in the first embodiment.

Next, the operation of the ignition device 1 of the present embodiment will be described based on the flow of FIG. 5.

First, in steps S1 and S2, when the ignition signal Ig is input, the output of the electromagnetic wave power Ps from the electromagnetic wave power supply 4 to the spark plug 2 is started. Since the state of the plasma formation space R is the first state St1 at the time of input of the ignition signal Ig, the electromagnetic wave power supply 4 outputs the first electromagnetic wave power Ps1.

In step S3, the reflected power detector 12 measures reflected power Pr from the spark plug 2. In step S4, based on the detected value of the reflected power detector 12, it is determined whether the state of the plasma formation space R has switched from the first state St1 to the second state St2. For example, the reflected power detector 12 continuously detects the reflected power Pr in a very short time. Specifically, last measurement of reflected power is compared with previous measurement of reflected power and when a predetermined change in reflected power is detected by power supply control unit 5, it can be estimated that the state of plasma formation space has switched from the first state St1 to the second state St2.

When it is determined that the first state St1 has been switched to the second state St2, in step S5, the electromagnetic wave power Ps input to the spark plug 2 is switched to the second electromagnetic wave power Ps2.

Thereafter, in step S6, the second electromagnetic wave power Ps2 is continuously output until it is determined that the second state St2 is switched to the third state St3. In step S7, when it is determined that the second state St2 is switched to the third state St3, the electromagnetic wave power Ps is switched to the third electromagnetic wave power Ps3. In the determination in step S6 according to the present embodiment, it is estimated that the second state St2 has been switched to the third state St3 when a predetermined time t0 has elapsed. Here, the predetermined time t0 can be, for example, a delay time from the start time point of the second state St2, which is obtained in advance by experiments or the like.

Thereafter, when a predetermined time t1 has elapsed in step S8, the output of the electromagnetic wave power Ps is stopped in step S9. Here, the predetermined time t1 is a time appropriately set based on various conditions. Thereafter, the flow of FIG. 5 is returned to "start" to prepare for the next discharge cycle.

The present embodiment provides the following functions and advantages.

In the ignition device 1, the electromagnetic wave power supply 4 has multiple oscillators 41 (41*a*, 41*b*, 41*c*) that respectively generate high frequency powers of different frequencies fa, fb, fc. The power supply control unit 5 configures the electromagnetic wave power supply 4 to output at least one of the number of high frequency powers as electromagnetic wave power Ps. Thus, impedance matching can be properly performed according to the state of the plasma formation space R. As a result, energy of electromagnetic wave Ps can be efficiently used as ignition energy.

The electromagnetic wave power supply 4 combines the plurality of high frequency powers in the combiner 43, and inputs it as the electromagnetic wave power Ps to the spark plug 2. Thereby, a plurality of high frequency powers of different frequencies fa, fb, fc can be simultaneously inputted to the spark plug 2 as the electromagnetic wave power Ps. Therefore, any one of the plurality of high frequency powers can be easily matched to the changing state of the plasma formation space R.

The power supply control unit 5 switches the combined ratio of the plurality of high frequency powers in time series during each discharge cycle, and inputs it to the spark plug 2 as the electromagnetic wave power Ps. This makes it possible to modify the combined ratio of high-frequency powers by increasing portion of the frequency which provides better matching condition for given state of plasma formation space R. The state of the plasma formation space R changes sequentially during each discharge cycle. As a result, impedance matching can be further facilitated, and more efficient input of the electromagnetic wave power Ps can be realized.

The power supply control unit 5 adjusts the configuration of the high frequency powers included in the electromagnetic wave power Ps depending on the value of reflected power measured by the reflected power detector 12. Thus, impedance matching can be more effectively performed according to the state of the plasma formation space R. That is, as the impedance matches, the reflected power Pr decreases. Therefore, the detected value of the reflected power Pr is fed back to adjust the configuration of the plurality of high frequency powers of different frequencies in the electromagnetic wave power Ps as appropriate. As a result, impedance matching can be achieved more effectively, and efficient electromagnetic wave power input can be realized.

As described above, according to the present embodiment, it is possible to provide an ignition device capable of efficiently utilizing energy of electromagnetic wave.

Second Embodiment

Figure 6:
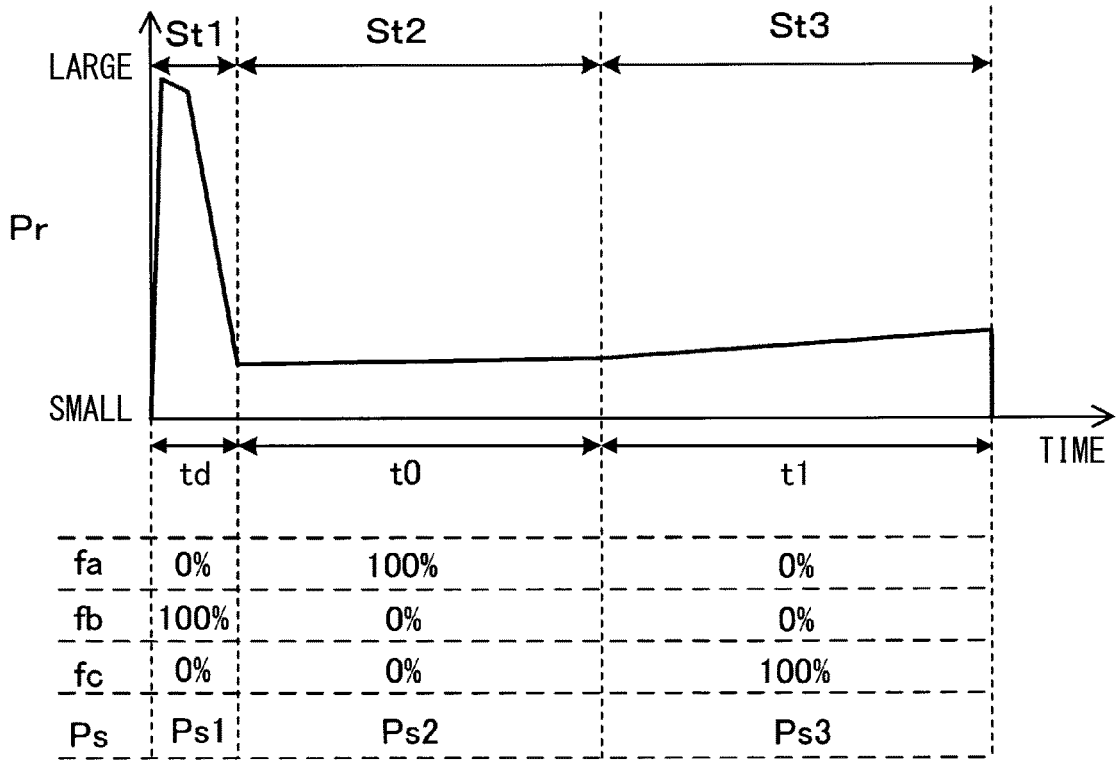
FIG. 6 is a conceptual diagram showing an example of the relationship between a change in reflected power during one cycle, a state of a plasma formation space, and a combined ratio of electromagnetic wave power in a second embodiment.

In the present embodiment, as shown in FIG. 6, the power supply control unit 5 sequentially switches the oscillators 41 used in the electromagnetic wave power supply 4.

That is, the power supply control unit 5 switches a plurality of high frequency powers generated by the plurality of oscillators 41 in time series during each discharge cycle, and inputs them to the spark plug 2 as the electromagnetic wave power Ps.

In other words, the high frequency power has a single frequency specified for each: the first electromagnetic wave power Ps1, the second electromagnetic wave power Ps2, and the third electromagnetic wave power Ps3 which are shown in the first embodiment are respectively generated from one of the oscillators 41. For example, the first electromagnetic wave power Ps1 is only the high frequency power of the frequency fb from the oscillator 41*b*.

That is, as shown in FIG. 6, 100% of the electromagnetic wave power Ps1 in the first state St1 is provided at frequency fb. Similarly, for example, 100% of the second electromagnetic wave power Ps2 in the second state St2 is provided at frequency fa generated by oscillator 41*a*. Similarly, for example, 100% of the third electromagnetic wave power Ps3 during the third state St3 is provided at frequency fc.

Other operations are the same as in the first embodiment.

Incidentally, among reference numerals used in the second and subsequent embodiments, the same reference numerals as those used in the embodiment already described represent the same components as those in the embodiment already described, unless otherwise indicated.

In the case of the present embodiment, it is possible to suppress the reflected wave more efficiently by setting the plurality of high frequency power frequencies fa, fb and fc appropriately. As a result, more efficient input of electromagnetic wave power can be achieved.

In addition, the second embodiment has the same functions and advantages as in the first embodiment.

Third Embodiment

Figure 7:
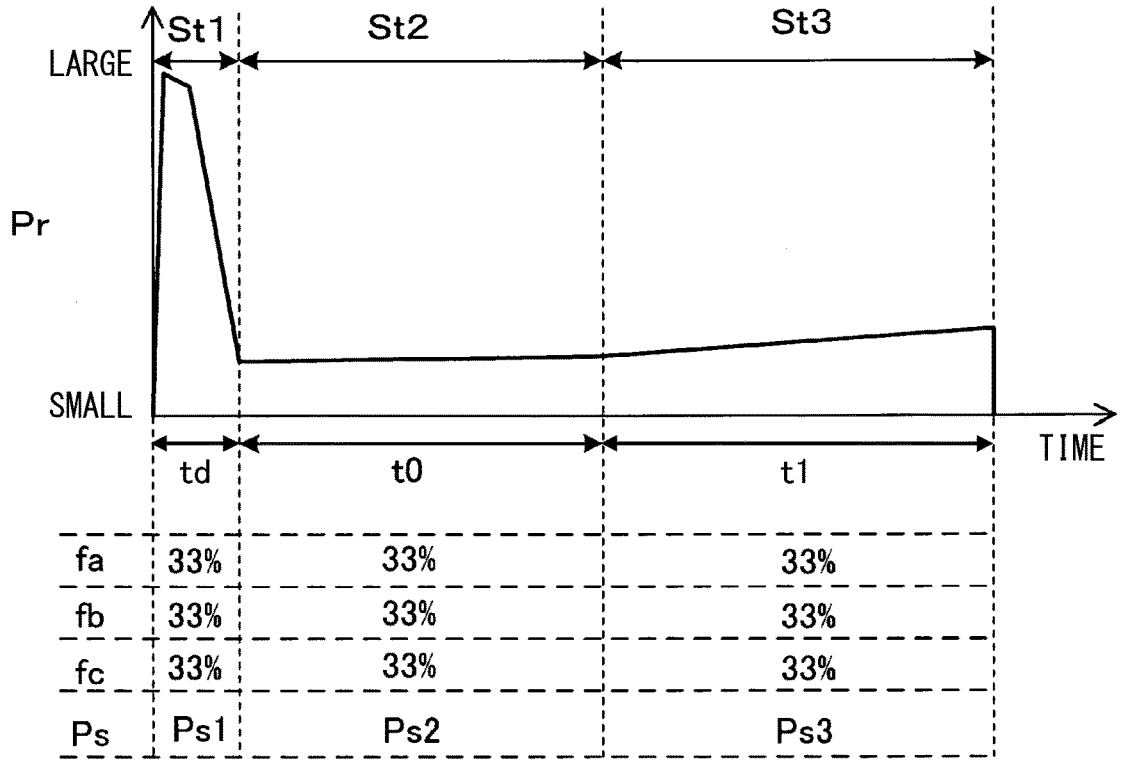
FIG. 7 is a conceptual diagram showing an example of the relationship between a change in reflected power during one cycle, a state of a plasma formation space, and a combined ratio of electromagnetic wave power in a third embodiment.
Figure 8:
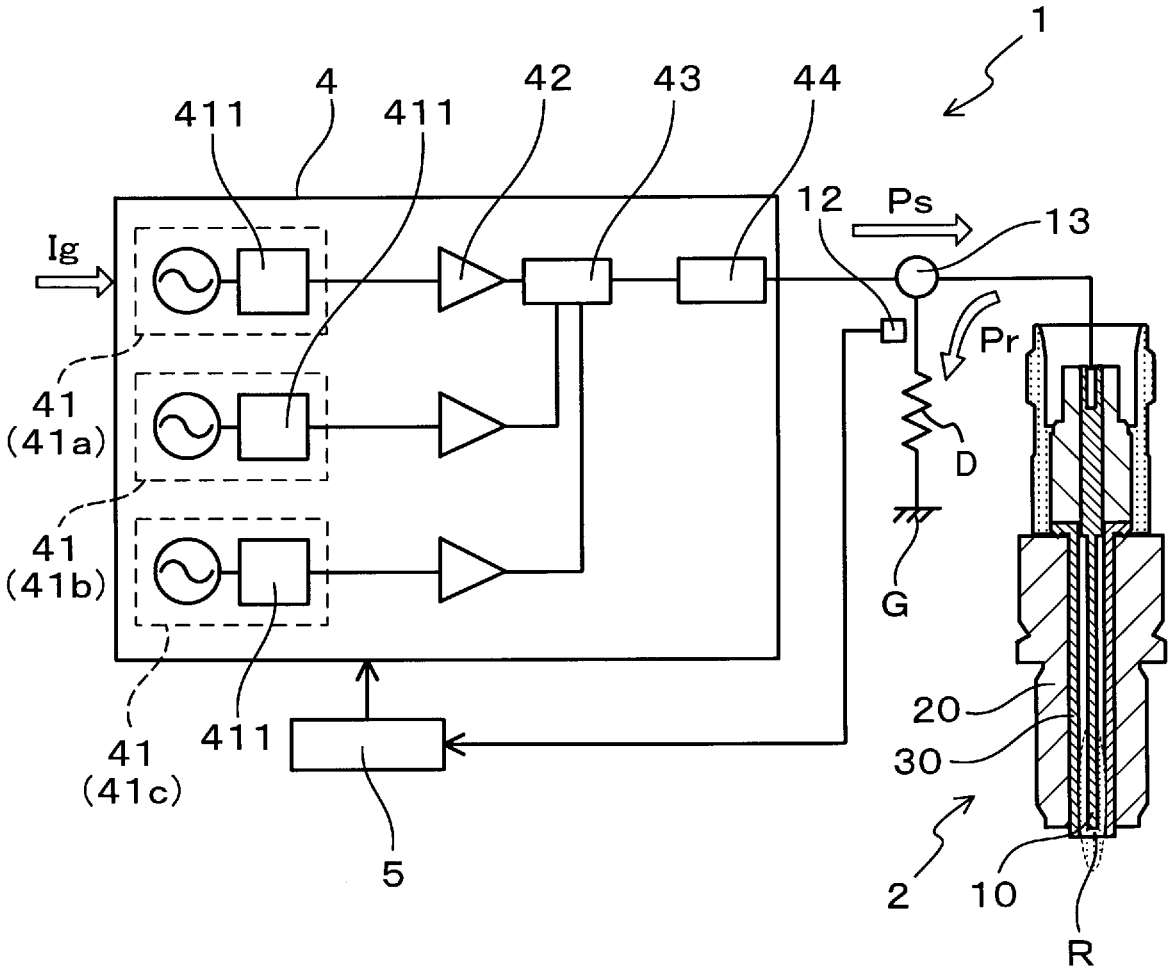
FIG. 8 is a schematic view of an ignition device according to a fourth embodiment.

In the present embodiment, as shown in FIG. 7, in one discharge cycle, the electromagnetic wave power Ps is input to the spark plug 2 without changing the combined ratio of a plurality of high frequency powers in the electromagnetic wave power Ps.

For example, electromagnetic wave power Ps can be combined from the high frequency power of the frequency fa from the oscillator 41*a*, from the high frequency power of the frequency fb from the oscillator 41*b*, and from the high frequency power of the frequency fc from the oscillator 41*c*. Then, the above combined ratios are not changed between the first state St1, the second state St2, and the third state St3 described above. That is, Ps1, Ps2 and Ps3 shown in FIG. 7 are produced at same high frequency power ratios and combined in electromagnetic wave power Ps.

Also, as for the combined ratio of power at three frequencies, for example, three high frequency powers can be made approximately equal. Alternatively, the ratio of the three high frequency powers can be set appropriately and these powers do not need to be equalized.

Other operations are the same as in the first embodiment.

Fourth Embodiment

In the fourth embodiment, as shown in FIGS. 8 to 11, each oscillator 41 has a frequency control unit 411 for adjusting the frequency. The frequency control unit 411 is configured to be able to finely adjust the frequency of the high frequency power generated by the oscillator 41.

In the present embodiment, the frequencies fa, fb, and fc of the plurality of high frequency powers included in the electromagnetic wave power Ps are finely adjusted in each cycle of operation of the internal combustion engine.

That is, as in the first embodiment and the second embodiment, the electromagnetic wave power Ps is combined in the electromagnetic wave power supply 4 combining the high frequency power of the frequency fb that matches with the first state St1, the high frequency of the frequency fa that matches with the second state St2, and the high frequency power of the frequency fc that matches with the third state St3. The electromagnetic wave power Ps constitutes of three high frequency powers which have frequencies of fa, fb and fc, which are finely adjusted by the frequency control unit 411 for each cycle of operation of the internal combustion engine.

The fine adjustment of the frequency is performed by the frequency control unit 411 via the power supply control unit 5 based on the reflected power value measured by the reflected power detector 12.

Figure 9:
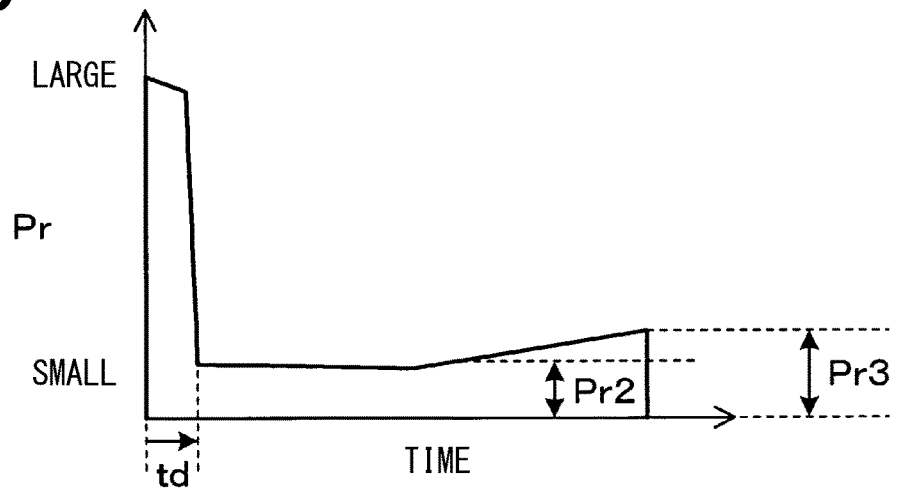
FIG. 9 is a diagram schematically illustrating time change of reflected power in the fourth embodiment.
Figure 10:
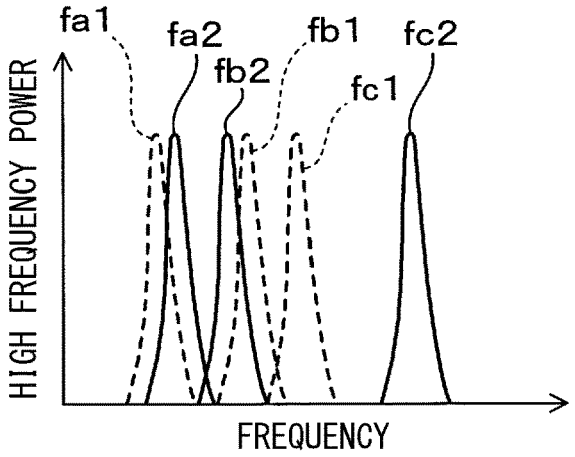
FIG. 10 is a diagram showing fine adjustment of multiple frequencies in the fourth embodiment.
Figure 11:
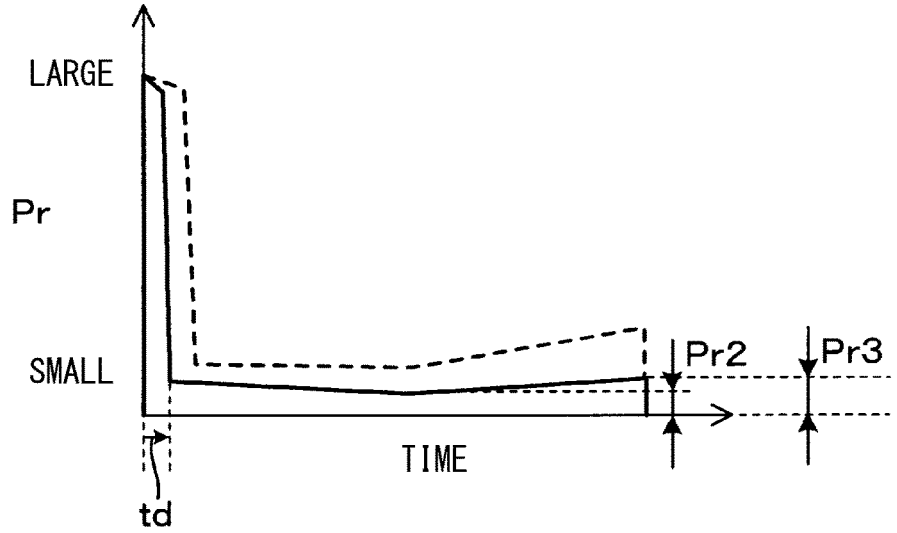
FIG. 11 is a diagram showing improvement in shape of a profile of reflected power between 2 discharge cycles in the fourth embodiment.

Example of the effect of fine frequency adjustment is shown in FIG. 10 and FIG. 11. During one discharge cycle the electromagnetic wave power Ps is combined from high frequency powers at frequencies fa1, fb1 and fc1, as shown in dashed line in FIG. 10 and inputted into the spark plug. Measured reflected profile at frequency configuration fa1, fb1 and fc1 will have a shape as shown in FIG. 9. At this time, when the discharge breakdown delay td shown in FIG. 9 is larger than the predetermined target value, the frequency fb of the high-frequency power that matches with the first state St1 is finely adjusted to the frequency fb2 in order to achieve better impedance matching.

Further, when the reflected power Pr2 in the second state St2 shown in FIG. 9 is larger than the predetermined target value, the frequency fa of the high frequency power that matches with the second state St2 is finely adjusted to the frequency fa2 in order to achieve better impedance matching.

Further, when the reflected power Pr3 in the third state St3 shown in FIG. 9 is larger than the target value, the frequency fc of the high frequency power that matches with the third state St3 is finely adjusted to the frequency fc2 in order to achieve better impedance matching.

As a result, as shown by the solid line in FIG. 11, in the next cycle, the discharge delay td can be suppressed, and the reflected power Pr in the second state St2 and the third state St3 can be suppressed. That is, the electromagnetic wave power Ps can be more efficiently used as the ignition energy. The dashed line in FIG. 11 is the same as the solid line in FIG. 9, and is a profile of the reflected power in the current cycle.

The frequency fa of the high frequency power that matches with the second state St2 and the frequency fc of the high frequency power that matches with the third state St3 can be changed in the same cycle.

Other operations are the same as in the first embodiment.

In the present embodiment, as described above, the electromagnetic wave power Ps obtained by combining a plurality of high frequency powers can be input to the spark plug 2 and the frequencies fa, fb and fc of the respective high frequency powers can be finely adjusted. As a result, impedance matching of the transmission line can be further facilitated, and more efficient ignition energy can be input.

In addition, the second embodiment has the same functions and advantages as in the first embodiment.

Experimental Example

Figure 12:
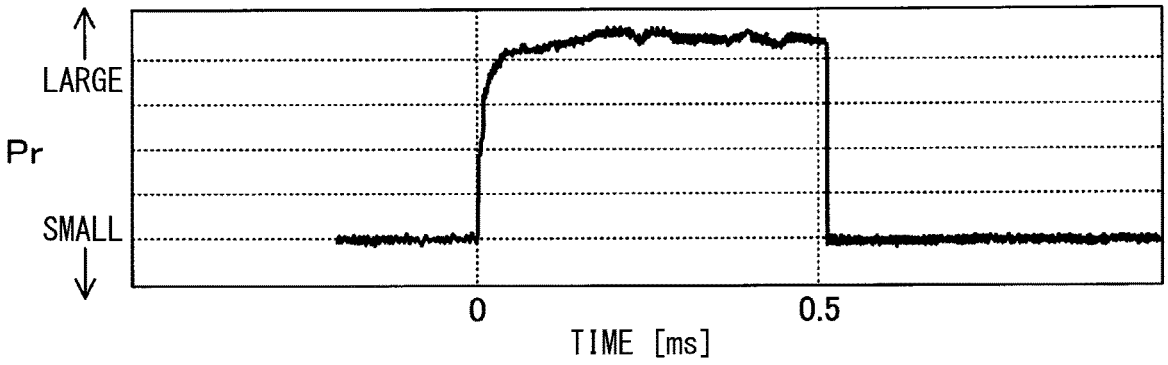
FIG. 12 is a diagram showing experimental example of a reflected power profile measured when input power is provided at single frequency f1.
Figure 13:
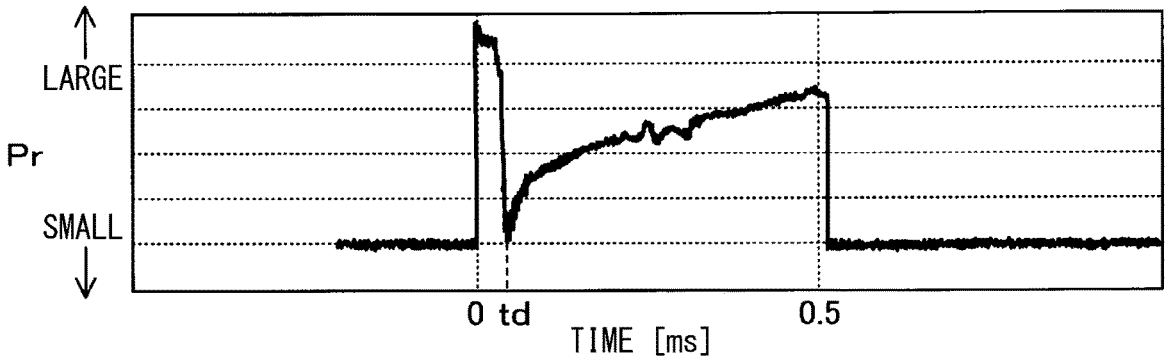
FIG. 13 is a diagram showing experimental example of a reflected power profile measured when input power is provided at single frequency f2.
Figure 14:
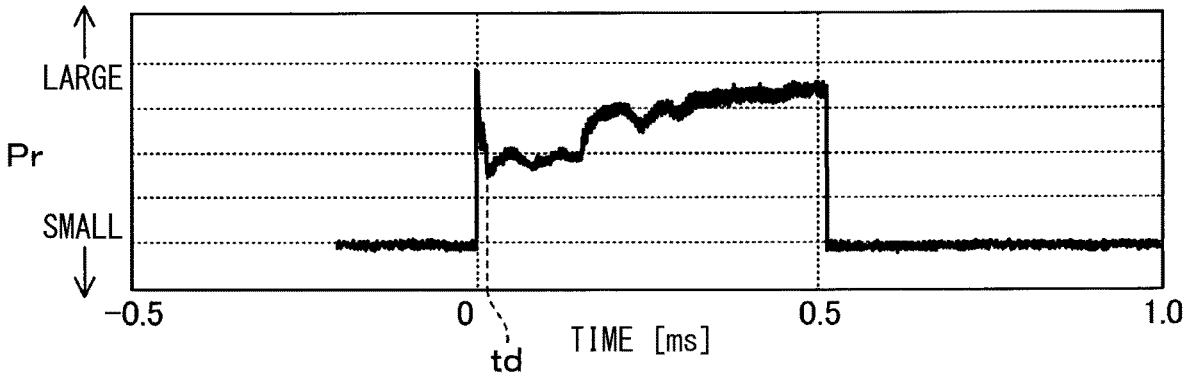
FIG. 14 is a diagram showing experimental example of a reflected power profile measured when input power is combined from 2 frequencies f1 and f2.

In this example, as shown in FIG. 12 to FIG. 14, it is confirmed that a difference appears in the profile of the reflected power Pr in the case where the electromagnetic wave power of one frequency is input and in case where the electromagnetic wave power of two frequencies are input. That is, the effects of the above-described embodiment are indirectly confirmed. In FIG. 12 to FIG. 14, the time when the ignition signal is turned ON is taken as the time of time "0 ms".

Specifically, first, as the electromagnetic wave power, the reflected power Pr was measured when high-frequency power of a single frequency f1 (here, 2.46 GHz) was input from the electromagnetic wave power supply to the spark plug. The result is shown in FIG. 12.

Next, as the electromagnetic wave power, the reflected power Pr was measured when high-frequency power of a single frequency f2 (here, 2.477 GHz) slightly higher than the above-mentioned frequency f1 was input from the electromagnetic wave power supply to the spark plug. The result is shown in FIG. 13.

Next, as electromagnetic wave power, the reflected power Pr was measured a combination of two high frequency powers of mutually different frequencies f1 and f2 (here, 2.46 GHz and 2.477 GHz) was input from the electromagnetic wave power supply to the spark plug. The result is shown in FIG. 14.

As shown in FIG. 12, when high frequency power of a single frequency f1 is inputted to the spark plug as electromagnetic wave power, the time from the start of power input to the start of discharge is short. However, the reflected power Pr is large after the discharge, that is, at the time of plasma formation (that is, the second state St2) and at the time of the initial flame formation (that is, the third state St3). That is, energy loss is large at the time of discharge. In the second state St2 and the third state St3, it is considered because the impedance of the electromagnetic wave power supply and that of the transmission line do not match.

Further, as shown in FIG. 13, when a single high frequency power of 2.477 GHz is inputted to the spark plug as the electromagnetic wave power, the discharge delay td becomes large. In the first state St1, it is considered because the impedance of the electromagnetic wave power supply and that of the transmission line do not match.

On the other hand, according to the profile of the reflected power Pr shown in FIG. 14, it is understood that the reflected power Pr can be suppressed even after the discharge while reducing the discharge delay time td. That is, by combining the plurality of high frequency powers to form the electromagnetic wave power, the high frequency power having one frequency of frequencies is matched with the first state St1, and the high frequency power having the other frequency is matched with the second state St2 and the third state St3.

Figure 15:
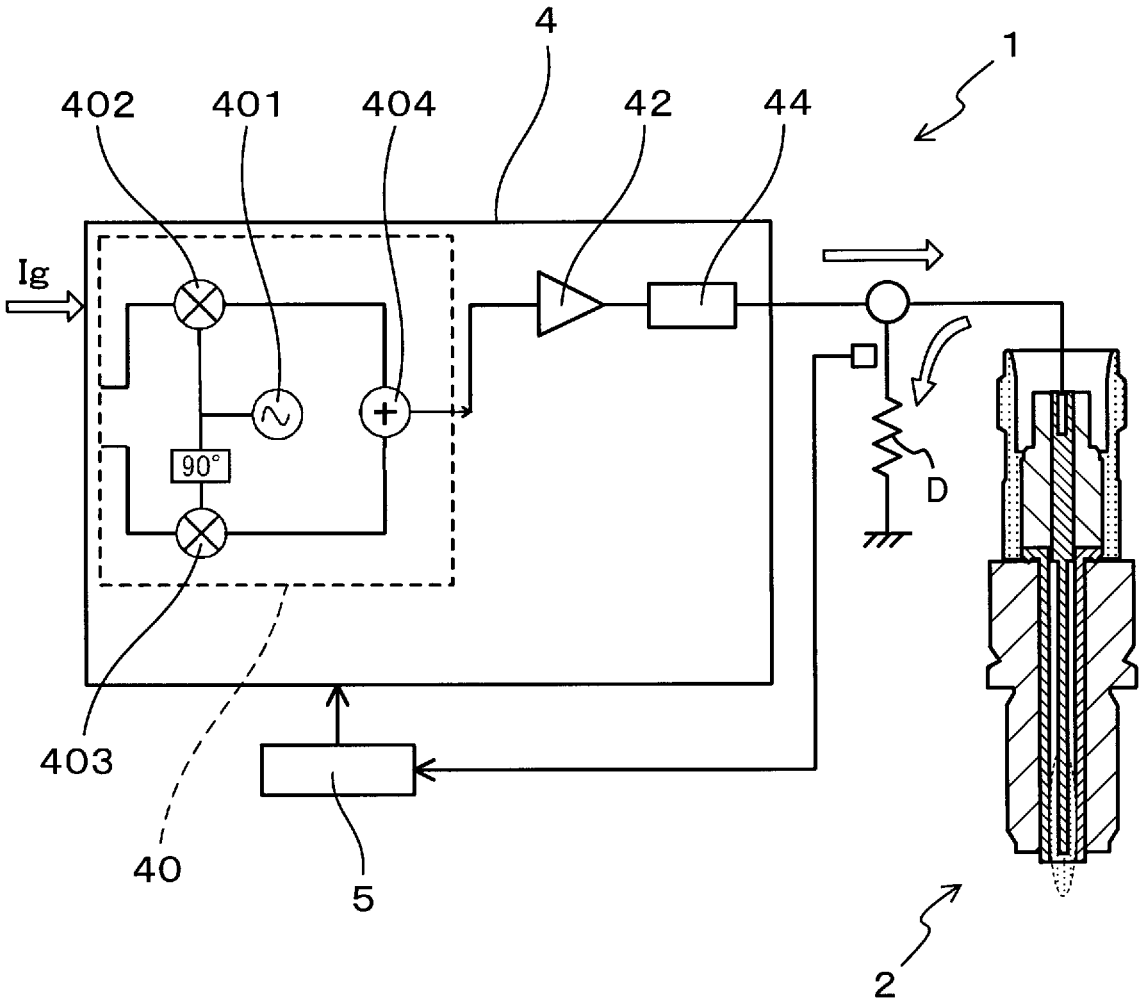
FIG. 15 is a schematic view of an ignition device according to a modified embodiment.

In the above embodiment, the electromagnetic wave power supply has three oscillators. However, the number of oscillators included in the electromagnetic wave power supply may be two, or four or more. Also, as an electromagnetic wave power supply, it is possible to use one that can control and combine a plurality of frequency components. That is, for example, as shown in FIG. 15, an electromagnetic wave power supply 4 with an IQ modulator 40 having a carrier wave oscillator 401, mixers 402 and 403, and an adder 404 can be used.

The present disclosure is not limited to the embodiments described above, and various modifications may be adopted within the scope of the present disclosure without departing from the spirit of the disclosure.

The invention claimed is:

1. An ignition device for igniting a mixture of air and fuel gas by plasma to generate an initial flame, comprising:

a spark plug having an inner conductor, a cylindrical outer conductor that holds the inner conductor inside, and a dielectric provided between the inner conductor and the outer conductor, and the spark plug configured to emit an electromagnetic wave to a plasma formation space between the inner conductor and the outer conductor to generate a plasma;

an electromagnetic wave power supply that generates the electromagnetic wave and delivers an electromagnetic wave power to the spark plug; and a power supply control unit that controls the electromagnetic wave power supply, wherein the electromagnetic wave power supply is configured to generate high frequency power at a number of different frequencies, the power supply control unit is configured to output at least one of the plurality of high frequency powers generated by the electromagnetic wave power supply as the electromagnetic wave power, the electromagnetic wave power supply includes multiple oscillators that respectively generate high frequency power at a number of different frequencies, and the electromagnetic wave power supply has a combiner configured to combine the high frequency power generated by the multiple oscillators, combines a plurality of the high, frequency powers in the combiner, and input it to the spark plug as the electromagnetic wave power.

2. The ignition device according to claim 1, wherein the power supply control unit adjusts the combined ratio of the plurality of high frequency powers in time series in one discharge cycle, and inputs it to the spark plug as the electromagnetic wave power.

3. The ignition device according to claim 2, wherein a first state that is a state in which plasma is not formed in the plasma formation space, a second state that is a state in which plasma is formed in the plasma formation space, and a third state is a state in which an initial flame is formed in the plasma formation space by plasma are states of the plasma formation space that sequentially change in time series in a short time during each discharge cycle.

4. The ignition device according to claim 3, wherein high frequency powers of three different frequencies are included in the electromagnetic wave power, the three high frequency power frequencies have the frequency that matches the impedance in the first state, the frequency that matches the impedance in the second state and the frequency that matches in the third state.

5. The ignition device according to claim 1, wherein the power supply control unit switches a plurality of the high frequency powers in time series in one discharge cycle, and inputs it to the spark plug as the electromagnetic wave power.

6. The ignition device according to claim 1, further comprising, a reflected power detector configured to detect the reflected power from the spark plug, wherein the power supply control unit adjusts a configuration of the high frequency power included in the electromagnetic wave power based on the reflected power by the reflected power detector.

7. The ignition device according to claim 1, wherein the electromagnetic wave power is input to the spark plug from the combiner though an impedance transformation unit, the impedance transformation unit being configured to match an impedance of the electromagnetic wave power supply to an impedance of the plasma formation space.

8. The ignition device according to claim 1, wherein the electromagnetic wave power is input to the spark plug from the combiner through an impedance transformation unit and a circulator, the impedance transformation unit being configured to match an impedance of the electromagnetic wave power supply to an impedance of the plasma formation space.

9. An ignition device for igniting a mixture of air and fuel gas by plasma to generate an initial flame, comprising:

a spark plug having an inner conductor, a cylindrical outer conductor that holds the inner conductor inside, and a dielectric provided between the inner conductor and the outer conductor, and the spark plug configured to emit an electromagnetic wave to a plasma formation space between the inner conductor and the outer conductor to generate a plasma;

an electromagnetic wave power supply that generates the electromagnetic wave and delivers an electromagnetic wave power to the spark plug; and a power supply control unit that controls the electromagnetic wave power supply, wherein the electromagnetic wave power supply is configured to generate high frequency power at a number of different frequencies, and the power supply control unit is configured to output at least one of the plurality of high frequency powers generated by the electromagnetic wave power supply as the electromagnetic wave power; wherein the power supply control unit adjusts the combined ratio of the plurality of high frequency powers in time series in one discharge cycle, and inputs it to the spark plug as the electromagnetic wave power; and a first state that is a state in which plasma is not formed in the plasma formation space, a second state that is a state in which plasma is formed in the plasma formation space, and a third state is a state in which an initial flame is formed in the plasma formation space by plasma are states of the plasma formation space that sequentially change in time series in a short time during each discharge cycle.

10. The ignition device according to claim 9, wherein high frequency powers of three different frequencies are included in the electromagnetic wave power, the three high frequency power frequencies have the frequency that matches the impedance in the first state, the frequency that matches the impedance in the second state and the frequency that matches in the third state.

* * * * *